United States Patent [19]

Kasahara et al.

[11] 4,114,548

[45] Sep. 19, 1978

[54] SEWING MACHINE WITH BASE EXTENSION

[75] Inventors: Takahiko Kasahara; Shigeharu Shichi, both of Anjo; Hideo Banno, Nagoya; Senji Suito, Kariya; Masayuki Kato, Owariasahi, all of Japan

[73] Assignee: Aisin Seiki Company, Limited, Japan

[21] Appl. No.: 808,088

[22] Filed: Jun. 20, 1977

[30] Foreign Application Priority Data

Jun. 25, 1976 [JP] Japan ..... 51-84184[U]

[51] Int. Cl.[2] ..... D05B 73/06

[52] U.S. Cl. ..... 112/258

[58] Field of Search ..... 112/260, 258, 217.1; 312/208, 308

[56] References Cited

U.S. PATENT DOCUMENTS

| | | | |
|---|---|---|---|
| 3,188,993 | 6/1965 | Szuba et al. | 112/258 |
| 3,726,237 | 4/1973 | Devey et al. | 112/217.1 X |

FOREIGN PATENT DOCUMENTS

| | | | |
|---|---|---|---|
| 175,135 | 11/1952 | Austria | 112/260 |
| 1,068,095 | 10/1959 | Fed. Rep. of Germany | 112/260 |

*Primary Examiner*—George H. Krizmanich

*Attorney, Agent, or Firm*—Oblon, Fisher, Spivak, McClelland & Maier

[57] ABSTRACT

A sewing machine includes a base extension which serves as both a work-supporting surface and a receptacle containing machine accessories therein. The base extension is so hinged to the machine that even when the machine is converted into a cylindrical bed type a sufficient space may be provided between the underside of the cylindrical bed and the upper surface of the rested base extension.

5 Claims, 5 Drawing Figures

SEWING MACHINE WITH BASE EXTENSION

BACKGROUND OF THE INVENTION

1. Field of the Invention

This invention relates generally to cylindrical base type sewing machines and more particularly to a base extension therefor whereby the cylindrical base is converted into a flat base or vice versa.

2. Description of the Prior Art

Conventionally, cylinder to flat conversion in a sewing machine has been made by attaching the base extension to the machine while flat to cylinder conversion has been made by completely removing the base extension from the machine. Accordingly, such base extension has to be stored or positioned somewhere separately from the sewing machine during a cylinder bed operation. This is because the base extension has a sufficient thickness to be utilized as a receptacle containing the machine accessories therein, and therefore, if the base extension is hinged to the sewing machine it is difficult to have a sufficient space between the underside of the cylindrical base and the upper surface of the base extension upon conversion into a cylindrical bed sewing machine due to the thickness of the base extension.

SUMMARY OF THE INVENTION

It is, therefore, an object of the present invention to provide an easily convertible sewing machine with a base extension which serves as both a work-supporting surface and an accessory receptacle.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DETAILED DESCRIPTION OF THE PREFERRED EMBODIMEMT

Figure 1:
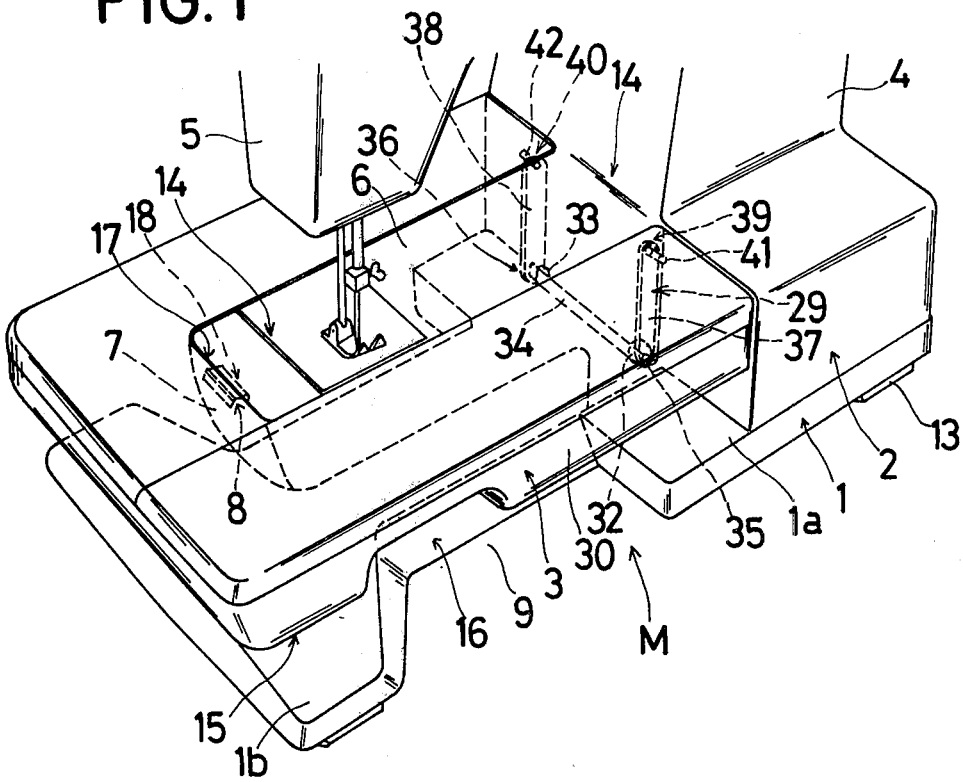
FIG. 1 is a perspective view of the sewing machine converted into a flat bed type sewing machine.

Referring now to the attached drawings, a sewing machine M generally includes a base plate 1 supporting the machine M thereon, an arm 2 having a cylindrical horizontal base or bed 6 and a standard 4 extending vertically from the cylindrical base 6, and a base extension or auxiliary bed 3 movably hinged to the arm 2 through operating means 29.

The standard 4 supports a horizontal upper arm (not shown) generally parallel to the horizontal base 6. A sewing head 5, extending vertically from the free end of the upper arm, encloses members (not shown) which drive a needle bar and presser bar (both are illustrated but not numbered).

Figure 2:
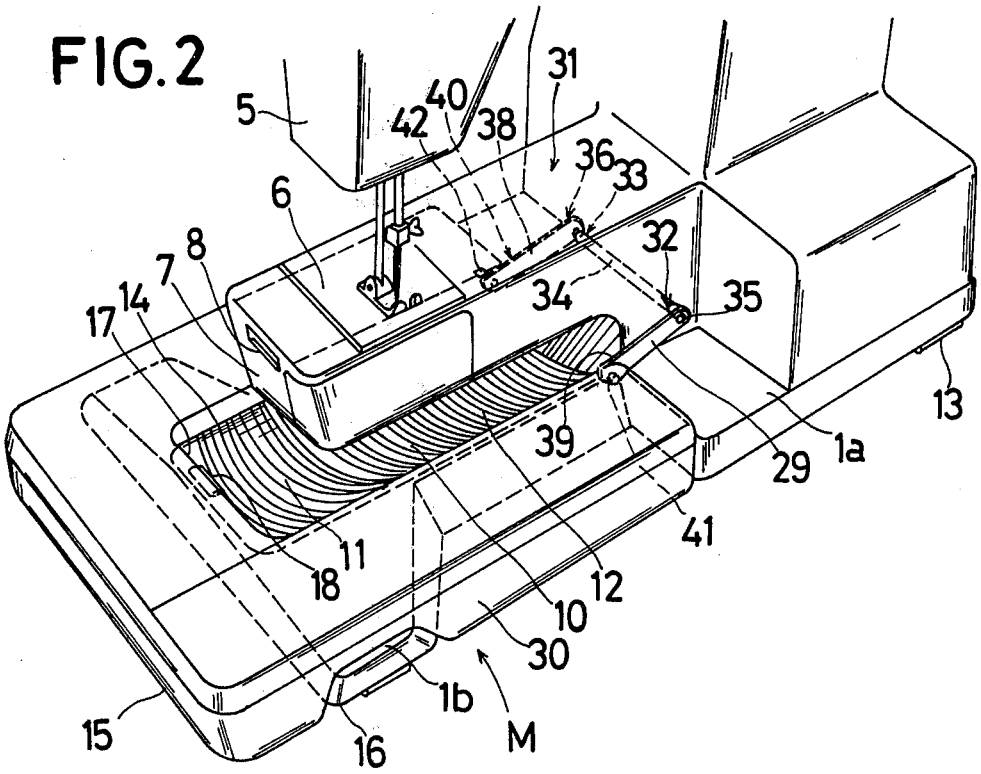
FIG. 2 is similar to FIG. 1 but showing the sewing maching converted into a cylindrical bed.

The base plate 1 is of substantially H-shape and comprises a pair of side bar portions 1*a*, 1*b* and a central transverse bar portion 10. A pair of cut-off portions 9,9 are defined between the side bar portions 1*a*, 1*b* for receiving the base extension 3 (later described in detail). The transverse bar portion 10 of the base plate 1 is provided with a recess or concavity 11, as best shown in FIG. 2, so that a sufficient space 12 may be provided between the underside of the cylindrical base 6 and the upper surface of the base plate 1. The standard 4 stands vertically from the right side bar portion 1*a* of the base plate 1.

The base extension 3 is of substantially C-shape and includes a recess 14 for receiving therein the cylindrical base 6 as shown in FIG. 1. The upper surface of the base extension 3 is designed to be coplanar with the upper surface of the cylindrical base 6 upon being converted into a flat bed sewing machine so that both surfaces may serve as a work supporting surface (FIG. 1).

The undersurface 15 of the base extension 3 is provided with a recess 16 in which is accommodated the left side bar portion 1*b* of the base plate 1 upon being converted into a cylindrical bed sewing machine as shown in FIG. 2.

Both side portions 30,30 of the C-shaped base extension 3 are accommodated in the cut-off portions 9,9 of the base plate 1, so that although the base extension 3 rides over the base plate 1 upon conversion into a cylindrical bed type sewing machine, the increase in the total thickness of the base means 1, 3 may be obviated. The under surface of the base extension 3 is then coplanar with that of the base plate 1.

An inward projection 18 is provided on an inner wall 17 of the base portion of the C-shaped base extension 3 and is engageable with a groove 8 provided on a side wall 7 of the free end of cylindrical base 6. When the base extension 3 is lifted to the position of FIG. 1, the projection 18 is engaged with the groove 8 for maintaining or locking the base extension at its lifted position.

Figure 5:
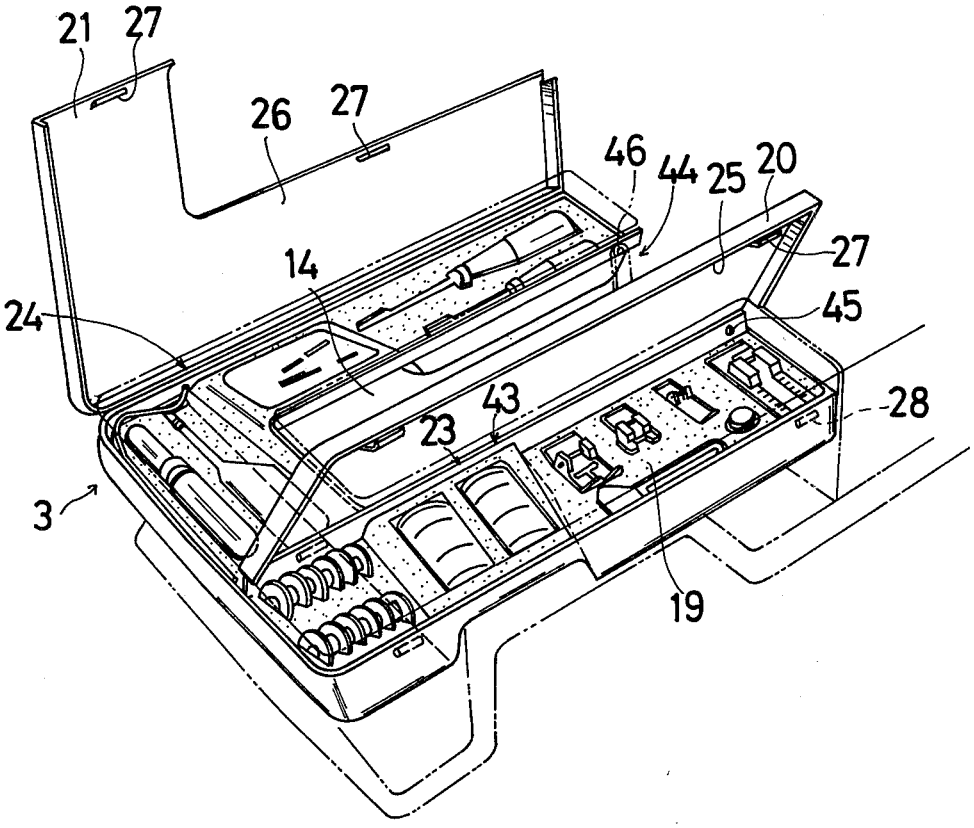
FIG. 5 is a perspective view of the base extension serving as a receptacle containing machine accessories.

The base extension 3 also serves as an accessory receptacle, as best shown in FIG. 5. The base extension 3 includes a receptacle body 19 in which are stored various machine accessories and attachments, illustrated in FIG. 5, and front and rear cover plates 20,21 hinged to the body 19 at inner and rear walls 23,24 thereof, respectively.

Each cover plate 20,21 has projections 27 at the inner sides 25,26 thereof which are engageable with recesses 28 for preventing accidental opening of the cover plates 20,21, as by vibration during operation of the machine M.

Since the cover plates 20,21 are separately provided, they may be opened independently of each other.

Referring now to the operating means 29, a pair of parallel levers 37,38 are at their one end 35,36 pivoted to the root of the cylindrical base 6 by means of a fulcrum rod 34 disposed within holes 32,33 of the cylindrical base 6. The levers 37,38 are at their other end 39,40 pivotted to the upper portions of the inside walls of the right ends of C-shaped base extension 3 by means of a pair of pins 41,42 pivotally riveted thereto.

Figure 3:
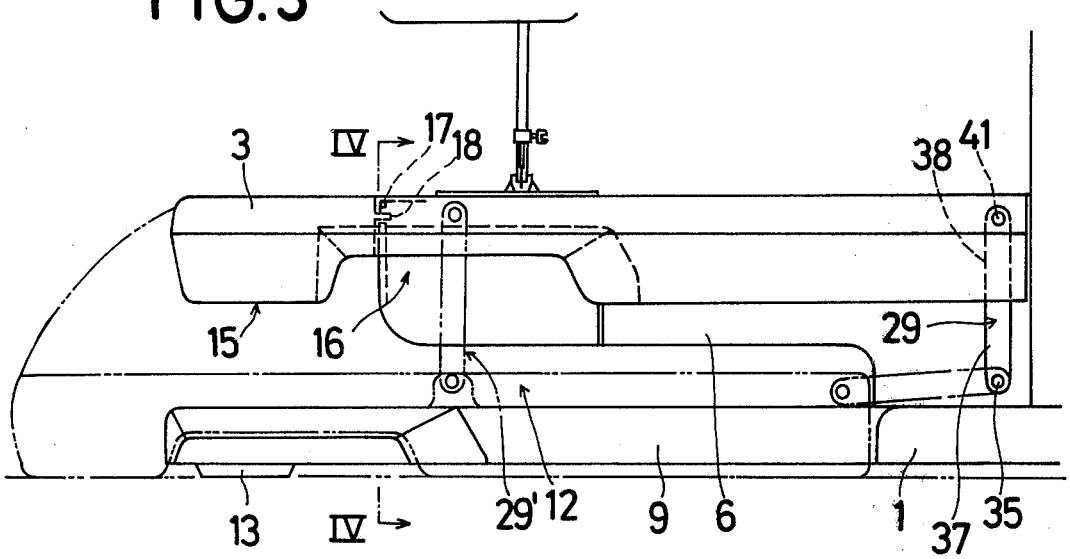
FIG. 3 is a front view of FIG. 1.
Figure 4:
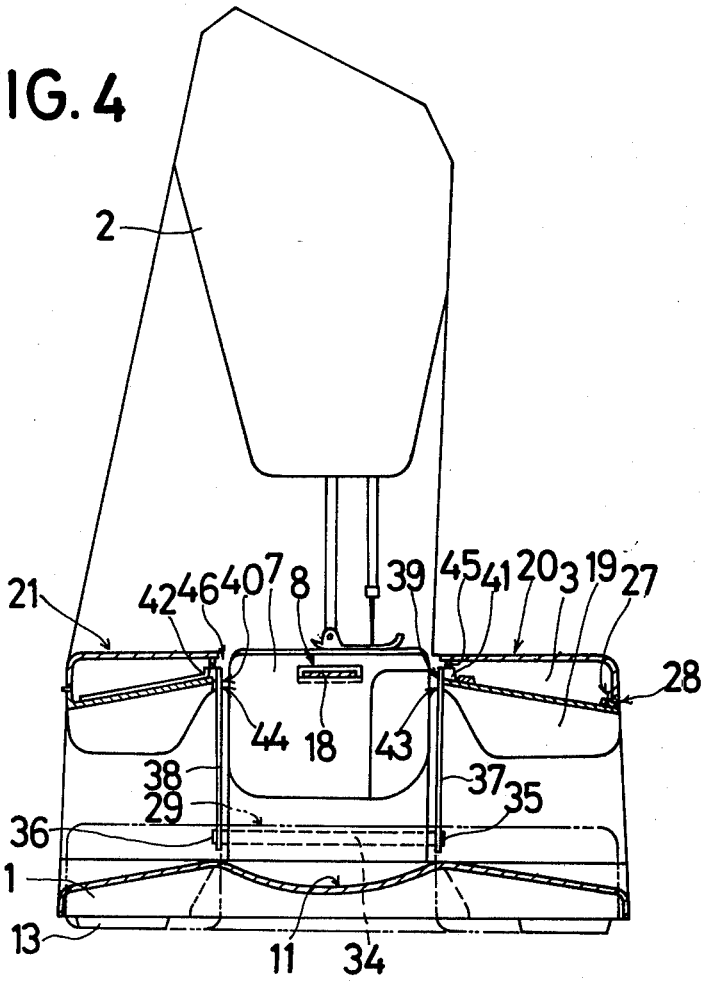
FIG. 4 is a cross-sectional view taken along the line IV—IV in FIG. 3.

As shown in FIGS. 3 and 4, when the levers 37,38 are in the upright positions, the upper surface of the base extension 3 is substantially coplanar with the upper surface of the cylindrical base 6.

When the sewing machine M is in use as a flat bed type sewing machine as shown in FIG. 1, the upper surfaces of the base 6 and the base extension 3 are coplanar with each other for allowing the operator to use both surfaces as a flat bed work supporting surface. Under such conditions, the base extension 3 is prevented from downward movement by engagement between the projection 18 and the groove 8.

Next, if the operator wishes to do work of the class normally performed on a cylindrical bed type sewing machine, she first moves the left end portion of the base extension 3 slightly upward in order to release the engagement between the projection 18 and the groove 8. Due to the disengagement therebetween, the base extension 3 moves dowward by the self-weight thereof. During this downward movement the base extension 3 is kept horizontal. The movement is based on a so-called parallel linkage mechanism. The operating levers 37,38 are then rotated about the rod 34 in a counterclockwise direction as viewed in FIGS. 1 to 3, rotatably supporting thereon the base extension 3.

After the downward movement of the base extension 3, the recess 16 of the undersurface 15 thereof rides over the left side bar portion 1*b* of the base plate 1 while both side portions 30,30 of the base extension 3 are received within the respective cut-off portions 9 of the base plate 1 so that the thickness of the base means 1,3 may not increase even when the two base means 1,3 are overlapped.

Under such conditions, since the space 12 between the underside of the cylindrical base 6 and the concavity 11 of the base plate 1 is sufficiently large, the work may pass through the space 12 without any interference.

From the above conditions, if the operator again wishes to do work of the class normally performed on the flat bed sewing machine, she moves the base extension 3 upwardly for engaging the projection 18 thereof with the groove 8 of the cylindrical base 6. The extension 3 is then returned to its original position shown in FIG. 1.

As illustrated with an imaginary line in FIG. 3, the operating means 29' may be additionally provided between the cylindrical base 6 and the left side portion of the base extension 3.

Having now fully described the invention, it will be apparent to one of ordinary skill in the art that many changes and modifications can be made thereto without departing from the spirit or scope of the invention as set forth herein.

What is new and desired to be secured by Letters Patent of the United States is:

1. A sewing machine comprising:

a base plate substantially of H-shape and having a concavity at the central transverse bar portion thereof;

a standard vertically supported upon one side bar portion of said H-shaped base plate;

a cylindrical base extending horizontally from said standard, the under surface of said base facing said transverse bar portion of said base plate;

a base extension substantially of C-shape and hinged to said cylindrical base;

said base extension being movable between a first position where the upper surface thereof is coplanar with that of said cylindrical base and a second position where the under surface thereof is coplanar with that of said H-shaped base plate;

a locking means normally maintaining said base extension at said first position including an inward projection provided on an inner wall at an end of said base extension and a groove member provided on a side wall of a free end of said cylindrical base such that said inward projection is lockably engageable with said groove member said cylindrical base being received in a central recess of said C-shaped base extension at said first position thereof; and said base extension having a recess at the underside thereof for accommodating the other side bar portion of said H-shaped base plate at the second position of said base extension.

2. A sewing machine as set forth in claim 1 further comprising:

a rod supported on said cylindrical base adjacent said standard, and at least two parallel levers each having one end thereof pivotably supported on said rod, and the other end thereof pivottably supported by said base extension.

3. A sewing machine as set forth in claim 1 wherein said base extension is formed as an open topped receptacle having a first and second cover plate hinged thereto for enclosing a receptacle, and means for preventing inadvertant opening of said first and second cover plates and for allowing said first and second cover plates to be opened independently.

4. A sewing machine as set forth in claim 2, which further comprises pin members pivotably riveted to upper portions of inside walls of said base extension and wherein said cylindrical base includes a first and second hole disposed in a lower portion of said cylindrical base within which said rod is disposed, said two parallel levers being pivoted to an upper portion of inside walls of said base extension by said pin members.

5. A sewing machine as set forth in claim 2, which further comprises a second rod interconnecting said cylindrical base and said base extension, said second rod being disposed adjacent an opposite end of said cylindrical base and said rod supported on said cylindrical base adjacent said standard.

* * * * *